US005724999A

United States Patent [19]

Kim

[11] Patent Number: 5,724,999

[45] Date of Patent: Mar. 10, 1998

[54] METHOD OF DECORATING A FINGER NAIL

[76] Inventor: Ho Choong Kim, 105 Windham Loop, Staten Island, N.Y. 10314

[21] Appl. No.: 759,440

[22] Filed: Dec. 5, 1996

[51] Int. Cl.[6] ..... A45D 24/00

[52] U.S. Cl. ..... 132/200; 132/73; 132/285

[58] Field of Search ..... 132/200, 73, 285, 132/333; 156/242, 245, 246

[56] References Cited

U.S. PATENT DOCUMENTS

| | | | |
|---|---|---|---|
| 3,598,685 | 8/1971 | Lee et al. | 132/73 |
| 3,736,946 | 6/1973 | Yando et al. | 132/73 |
| 3,898,357 | 8/1975 | Miller et al. | 132/73 |
| 4,947,876 | 8/1990 | Larsen | 132/73 |
| 4,974,610 | 12/1990 | Orsini | 132/73 |
| 5,133,369 | 7/1992 | Billings | 132/73 |

*Primary Examiner*—Gene Mancene
*Assistant Examiner*—Philogene Pedro
*Attorney, Agent, or Firm*—Baker & Botts

[57] ABSTRACT

A finger nail is decorated with an image printed on a piece of glossy coated paper, such as from a magazine, by applying a film-forming substance over the image to the piece, the substance including a resin and a solvent that is capable upon drying of forming a film that is sufficiently flexible and extensible to permit it to conform to the surface of the nail. After allowing the substance to dry and form the film, the paper under the film is wetted with water and the paper is removed to leave a film/image/paper-coating sandwich that is substantially free of paper fibers. The sandwich is cut to form a blank of a size and shape to fit the margins of the cuticle bordering the finger nail. The sized and shaped blank is applied to the finger nail, and a settable nail top coat substance in liquid form is applied over the blank and allowed to dry.

6 Claims, 2 Drawing Sheets

METHOD OF DECORATING A FINGER NAIL

BACKGROUND OF THE INVENTION

It is quite popular among women to decorate their finger nails with some sort of graphic image rather than a solid color. In some instances, images are hand-painted by artistically skilled manicurists. Most often, however, images are applied to finger nails by printed transfer decals. The use of decals limits the choice of images to those that the manicurist has on hand.

A few years ago, a kit was available that allowed manicurists to apply custom images to finger nails. The custom images were produced from positive photographic prints or other original image materials, usually color photoprints supplied by the customer. The customer's photograph or other original material was first photocopied onto plain paper using a photocopying machine. In most instances, the original was reduced in size to provide an image of a size that would fit the nail. A settable film-forming substance provided with the kit was applied to the photocopy on the image side and allowed to dry. The paper was then wet with water to soften the paper so that most of it could be scraped off the back of the image and film. The vestigial image-bearing paper and film composite was then cut to fit the nail, and many small slits were made transversely to the edge matching the cuticle line so that the image-bearing film could be made to conform to the curvature of the nail. After applying the cut, image-bearing paper/film composite to the nail, a top coat was applied.

The process described above was extremely time-consuming and difficult to do correctly. First, the photograph (or other original) had to be photocopied, which often required the manicurist to use an outside copy shop with a color printer. The film-forming substance applied to the photocopy took an hour or two to dry. Removal of the paper was a critical step—the toner image on the photocopy was inherently fused to the fibers of the paper at and near the surface. Therefore, it was necessary to leave some of the paper on the film-coated photocopy. Otherwise, some of the image would be removed. The film on the photocopy was essentially non-extensible and would not conform to the nail without making the slits along the edges. Even with the slits, the edge along the cuticle line did not fit firmly to the nail but instead formed ridges where the film and residual paper overlapped at the slits. The ridges were unsightly and prone to releasing in a short time, thus making the decoration relatively short-lived. The photocopy was necessarily degraded in quality, relative to the original. No doubt due to the difficulties of using the process, the time that the process required, and the low quality and short life of the decoration the process produced, the process was not commercially successful and the kit is no longer available.

SUMMARY OF THE INVENTION

An object of the present invention is to provide a nail decoration that enables the customer to have a vast choice of designs of the image produced on the finger nail. Another object is to enable a nail to be decorated by a process that takes only a few minutes to carry out. Still a further object is to enable a manicurist or a non-professional to become highly proficient in applying decoration to a nail with very little practice. It is also an object of the present invention to provide nail decoration that is of high quality and very attractive, in that it contains an original printed image and conforms exactly to the shape of the nail without ridges or wrinkles, and that lasts a relatively long time.

The foregoing objects are attained, in accordance with the present invention, by a method of decorating a finger nail that uses any image selected by the customer that is printed on glossy coated paper, which is the case with virtually all magazines. It has been found, in particular, that the ink images on glossy coated paper are exclusively on the coating and are not fused or otherwise bonded to the paper substrate under the coating. Thus, it is possible to remove virtually all of the paper without removing the printed image.

In order to remove the paper and leave the image, it is necessary, according to the present invention, to apply a film-forming substance in liquid form over an area that includes the image and is of a size not less than the size of the finger nail. The substance, upon drying, forms a sandwich with the coating on the paper and the image that is self-sustaining. The substance includes a resin and a solvent and is capable of forming upon evaporation of the solvent a film that is sufficiently flexible and extensible or pliable to permit it to conform exactly to the surface of the nail by stretching somewhat over the raised part of the nail within the cuticle line so that the edges fit the nail along the cuticle line without wrinkles and the center part fits smoothly over the top of the nail throughout.

After the film-forming substance dries to form the film, the paper under the film is wetted with water to soften the paper and permit it to be removed from the film/image/coating sandwich and to form a blank bearing the image and substantially free of paper fibers. Either before or after removing the paper, the blank is cut to form an edge that matches the cuticle line and is then pressed onto the nail. A settable nail top coat substance in liquid form is applied over the blank. The top coat substance, preferably, includes a resin and a solvent that is also a solvent for the film-forming substance so that the film is softened and adheres to the finger nail. Upon drying of the top coat, the nail is finished.

Removal of the paper from the film/image/coating sandwich is facilitated by abrading it with an abrasive material, such as sandpaper or a soft polymeric pad or block coated on one side or face with a grit material. After abrading the back surface of the paper, the paper is easily and quickly removed virtually completely by the manicurist's finger nail or a dull scraping blade.

It is very helpful to cut the blank to the size and shape of the nail with the aid of a template having a margin substantially matching the cuticle line of the finger nail. A template card having several sizes and a scale for measuring the particular nail to which the blank is to be applied may be provided as part of a kit. Preferably, the blank is cut to a length longer than the nail and is trimmed at a tip to match the tip of the nail after it is applied to the nail.

It has been found that after the paper is removed, any white (unprinted) portions of the film/image/coating sandwich are either transparent or translucent. That opens up the possibility of allowing the customer (or the manicurist) to choose a colored nail polish, the color of which will be the background for the printed image, since the polish shows through the translucent or transparent sandwich. The nail polish is, of course, applied to the finger nail before applying the sized and shaped blank.

For a better understanding of the invention, reference may be made to the following description of an exemplary embodiment, taken in conjunction with the accompanying drawing.

DESCRIPTION OF THE EMBODIMENT

Figure 1:
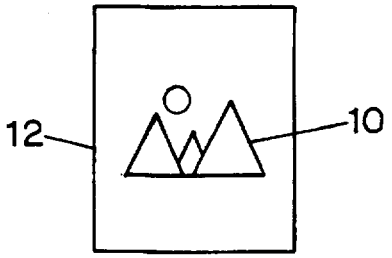
FIG. 1 is an illustration of a piece of printed material with an image chosen in accordance with a preferred embodiment of the present invention.

The process begins with the selection, usually by the customer, of an image that is printed on a glossy coated paper (FIG. 1). The image 10 may be chosen from virtually any glossy magazine and, of course may have any content that the customer wants—most good quality magazines are suitable. A piece 12 of a size somewhat larger than the fingernail to which it is to be applied is cut out of the magazine or other original printed material.

Figure 2:
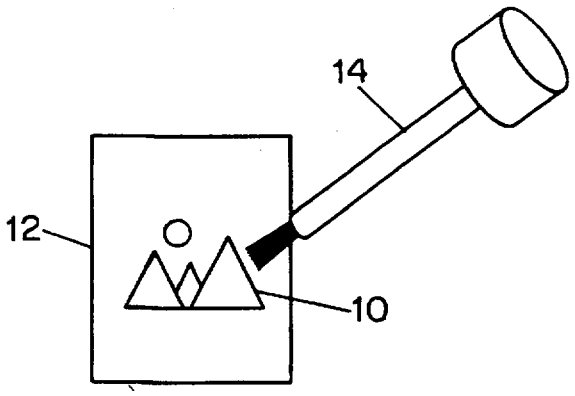
FIG. 2 is an illustration of the step of applying a film-forming substance to the piece of FIG. 1 in accordance with a preferred embodiment of the present invention.

The manicurist (who might well be the person whose nail is to be decorated—the process is easy enough to be performed by non-professionals) applies a film-forming substance in liquid form to the piece 12, preferably using an applicator brush 14 (FIG. 2). The substance includes a resin and a solvent and is formulated so as to be capable of forming upon evaporation of the solvent a film that is sufficiently flexible and extensible or pliable to permit it to conform to the surface of the nail. Although many commercially available nail top coats have been tried, only one has been found to provide upon drying a film that has the desired characteristics. The one that works is available from Marin Picard, Division of Pan Chemical; 115-117 Moonachie Avenue; Rutherford, N.J. (phone 210-438-7878) as Product Code A796-40D.

Figure 3:
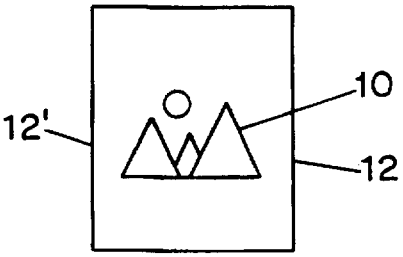
FIG. 3 is an illustration of the step of allowing the film-forming substance of FIG. 2 to dry in accordance with a preferred embodiment of the present invention.
Figure 7:
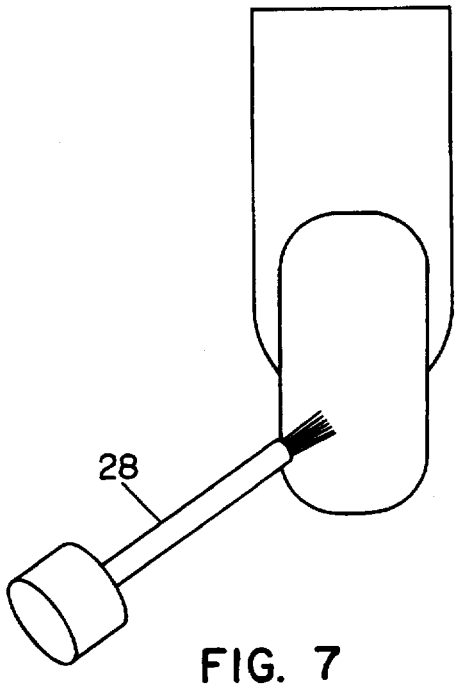
FIG. 7 is an illustration of the step of applying nail polish to the nail prior to application of the blank of FIG. 6 in accordance with a preferred embodiment of the present invention.

After application, the film-forming substance is allowed to dry (FIG. 3) by evaporation at ambient temperature of the solvent or solvents. The substance used by the present inventor dries sufficiently in about three minutes. During that time, the manicurist may apply a polish to the nail with a polish brush 28 (FIG. 7). Upon drying the piece 12 bearing the image 10 has a resin film on the image side that produces a self-sustaining sandwich 12' of the film, the printed image 10, and the coating on the paper after the paper is removed.

Figure 4:
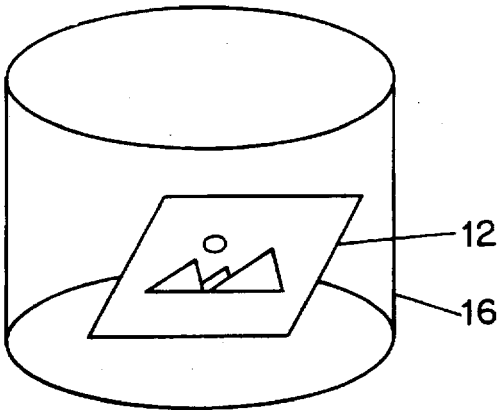
FIG. 4 is an illustration of the step of wetting the piece of FIG. 3 in accordance with a preferred embodiment of the present invention.
Figure 5:
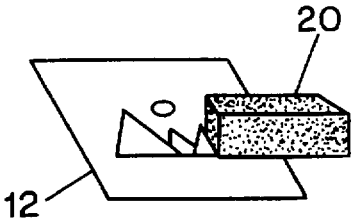
FIG. 5 is an illustration of the step of abrading and partially removing the coating and paper of the piece of FIG. 4 in accordance with a preferred embodiment of the present invention.

The paper is removed from the sandwich 12' by first wetting the paper, such as by immersing the piece 12 in a container 16 of water (FIG. 4) for a few seconds. The coating and paper on the side of the piece 12 opposite from the image 10 is abraded and partially removed, mostly as particles, using an abrasive block (FIG. 5), such as a polymeric foam pad 20 having a abrasive material applied to one face. After some abrasion of the coating/paper, it is desirable to immerse the piece 12 once again or perhaps repeatedly, with further abrasion or scraping with a fingernail or a dull blade after each immersion. It takes only a minute or two to remove virtually all of the paper from the film/image/coating sandwich 12'. The paper coating to which the image is affixed remains substantially intact and keeps the image from being marred when the paper is removed.

Figure 6:
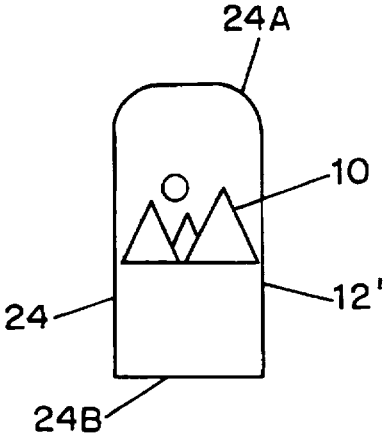
FIG. 6 is an illustration of a blank formed from the piece of FIG. 5 in accordance with a preferred embodiment of the present invention.

It is, of course, not desirable to try to cut the sandwich 12' to the size of the nail when it is in place on the nail. Therefore, the sandwich is cut to form a blank 24 (FIG. 6) matching the size and shape of the nail with the aid of a template (not shown), such as a semi-rigid plastic card formed with holes of various sizes, each shaped to match substantially the cuticle line of the nail to which the decoration is to be applied. The template may have a scale along part of one edge for measuring the width of the nail, and each template hole is labelled to match one unit of the scale. The template is, preferably, provided with holes that are longer than the finger nails, so only the margin **24*a* of the blank 24 that is fitted to the cuticle line is cut to size. The margin 24*b* at the tip of the nail is cut to match the nail tip after the sized and shaped blank 24** is applied to the nail.

As mentioned above, a nail polish will usually be applied to the nail (FIG. 7) at a convenient time prior to applying the blank 24 to the nail. The polish may be white for a white background or of any desired color, which will be a background color for the image 10, inasmuch as any part of the image that is white is not printed and becomes clear or translucent when the paper is removed from the piece 12.

Figure 9:
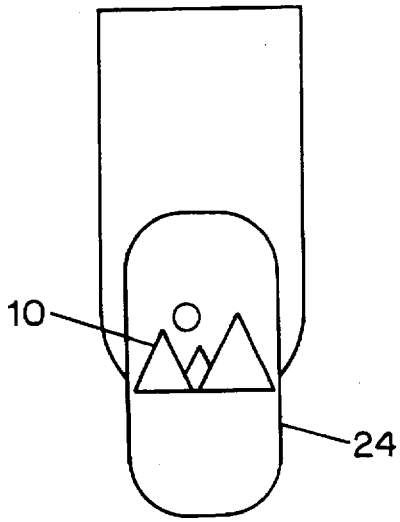
FIG. 9 is an illustration of the applied blank of FIG. 8 after being trimmed in accordance with a preferred embodiment of the present invention.
Figure 8:
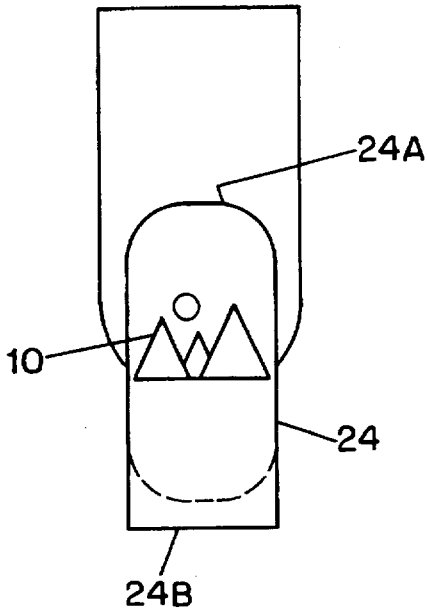
FIG. 8 is an illustration of the step of applying the blank of FIG. 6 to the nail in accordance with a preferred embodiment of the present invention.
Figure 10:
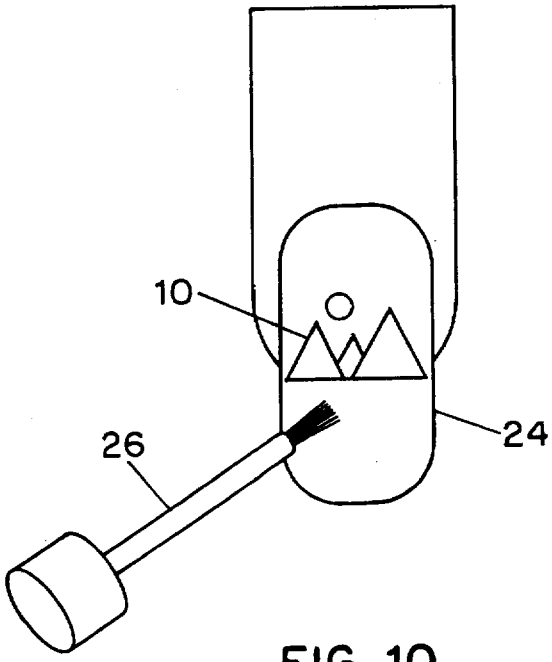
FIG. 10 is an illustration of the step of applying a top coat to the blank of FIG. 9 in accordance with a preferred embodiment of the present invention.

The blank 24 is applied to the nail, slid into place, and pressed down to engage the entire surface of the nail beneath it (FIG. 8). The flexibility and extensibility of the film allow the blank to stretch over the top of the nail and the margins along the cuticle to lie flat without wrinkling. After being applied, the tip **24*b* is trimmed to match the tip of the nail the result shown in (FIG. 9). A top coat is then applied with a top coat brush 26 over the entire blank 24 and allowed to dry (FIGS. 9 and 10). The film-forming substance applied to the blank may be used as the top coat. In any case, the solvent for the top coat should be a solvent for the film-forming substance, so that the film on the blank 24** is softened and forms a bond with the top coat. After drying of the top coat for a few minutes, the nail is finished.

The process may be carried out using a kit that contains all of the special materials used in the process, namely:

A bottle of the film-forming substance with an applicator brush 14;

An abrasive block 18;

A template for forming the sized and shaped blanks 24;

A bottle of top coat with a top coat brush 26 for applying it;

A detailed instruction sheet or booklet.

I claim:

1. A method of decorating a finger nail comprising the steps of providing a piece of a glossy coated paper having a size not less than the size of the finger nail and bearing a desired printed image, applying a film-forming substance in liquid form over the image to the piece of paper, the substance including a resin and a solvent and being capable of forming upon evaporation of the solvent a film that is sufficiently flexible and extensible to permit the film and image to conform to the surface of the finger nail, allowing the substance to dry and form the film, wetting the paper under the film with water, removing the paper from the film and image to form a film blank bearing the image and substantially free of paper fibers, cutting the blank to a size and shape to fit the margins of the cuticle bordering the finger nail, applying the sized and shaped blank to the finger nail, applying a settable nail top coat substance in liquid form over the blank, and allowing the top coat to dry.

2. The method according to claim 1 wherein the paper is removed from the film and image by first abrading the paper with an abrasive material and then scraping the paper off.

3. The method according to claim 1 wherein the film blank is cut with the aid of a template having a margin of a size and shape substantially matching the cuticle line of the finger nail.

4. The method according to claim 3 wherein the film blank is cut to a length longer than the finger nail and is trimmed to match the tip of the finger nail after the blank is applied to the finger nail.

5. The method according to claim 1 and further comprising the step of applying a nail polish to the finger nail before applying the sized and shaped blank.

6. The method according to claim 1 wherein the top coat substance includes a resin and a solvent that is also a solvent for the film-forming substance so that the film is softened and adheres to the top coat.

* * * * *